US011428051B2

(12) United States Patent
Ogelohwohor

(10) Patent No.: US 11,428,051 B2
(45) Date of Patent: Aug. 30, 2022

(54) BOTTOM HOLE ASSEMBLIES WITH EXPANDABLE CLADDING SHEATHS FOR DRILLING AHEAD THROUGH A LOST CIRCULATION ZONE OF A WELLBORE

(71) Applicant: Saudi Arabian Oil Company, Dhahran (SA)

(72) Inventor: Onos Sunday Ogelohwohor, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/147,674

(22) Filed: Jan. 13, 2021

(65) Prior Publication Data

US 2022/0220810 A1 Jul. 14, 2022

(51) Int. Cl.

| | |
|---|---|
| ***E21B 10/08*** | (2006.01) |
| ***E21B 10/64*** | (2006.01) |
| ***E21B 23/03*** | (2006.01) |
| ***E21B 29/00*** | (2006.01) |

(52) U.S. Cl.

CPC ..... *E21B 10/64* (2013.01); *E21B 10/08* (2013.01); *E21B 23/03* (2013.01); *E21B 29/005* (2013.01)

(58) Field of Classification Search

CPC ..... E21B 10/08; E21B 10/64; E21B 23/03; E21B 29/00; E21B 29/005; E21B 43/103

See application file for complete search history.

(56) References Cited

U.S. PATENT DOCUMENTS

| | | | | |
|---|---|---|---|---|
| 7,387,169 | B2 | 6/2008 | Harrall et al. | |
| 7,387,174 | B2 * | 6/2008 | Lurie | E21B 7/20 175/171 |
| 7,478,686 | B2 * | 1/2009 | Richard | E21B 7/20 175/57 |

(Continued)

FOREIGN PATENT DOCUMENTS

| | | | | |
|---|---|---|---|---|
| WO | WO-2005052304 | A1 * | 6/2005 | E21B 23/01 |
| WO | 2019236271 | A1 | 12/2019 | |

OTHER PUBLICATIONS

Notification of Transmittal of the International Search Report and the Written Opinion of the International Searching Authority, or the Declaration dated Mar. 9, 2022 pertaining to International application No. PCT/US2022/011642 filed Jan. 7, 2022, 14 pages.

*Primary Examiner* — Matthew R Buck
(74) *Attorney, Agent, or Firm* — Dinsmore & Shohl LLP

(57) ABSTRACT

Bottom hole assemblies for drilling through a lost circulation zone of a wellbore includes a drill string, a drill bit and a cladding seat coupled to the drill string, an expandable cladding sheath engaged with the cladding seat, a release mechanism coupling an uphole end of the expandable cladding sheath to the drill string, and an expander translatable axially along the drill string. The expandable cladding sheath is a fiber reinforced polymer. The cladding seat releasably couples a downhole end of the expandable cladding sheath to the drill string, and the release mechanism operates to release the uphole end of the expandable cladding sheath from the drill string. The expander deforms the expandable cladding sheath outward into contact with a wall of a wellbore when translated axially through a central cavity of the expandable cladding sheath. The bottom hole assembly may enable drilling ahead through a lost circulation zone.

20 Claims, 8 Drawing Sheets

(56) References Cited

U.S. PATENT DOCUMENTS

| | | | | |
|---|---|---|---|---|
| 7,694,738 | B2 | 4/2010 | Reddy et al. | |
| 7,975,771 | B2 | 7/2011 | Ford | |
| 8,522,885 | B2 | 9/2013 | Giroux et al. | |
| 9,470,059 | B2 * | 10/2016 | Zhou | E21B 23/04 |
| 9,995,108 | B2 | 6/2018 | Allen et al. | |
| 10,584,564 | B2 * | 3/2020 | Sherman | C08K 3/08 |
| 10,689,926 | B2 * | 6/2020 | Zhou | E21B 43/08 |
| 2007/0144784 | A1 * | 6/2007 | Head | E21B 4/18 175/57 |
| 2013/0068481 | A1 | 3/2013 | Zhou | |
| 2016/0312570 | A1 | 10/2016 | Kitzman | |
| 2018/0087350 | A1 | 3/2018 | Sherman | |
| 2018/0187492 | A1 * | 7/2018 | Amri | E21B 43/103 |
| 2019/0249512 | A1 | 8/2019 | Foster et al. | |

* cited by examiner

BOTTOM HOLE ASSEMBLIES WITH EXPANDABLE CLADDING SHEATHS FOR DRILLING AHEAD THROUGH A LOST CIRCULATION ZONE OF A WELLBORE

BACKGROUND

Field

The present disclosure relates to natural resource well drilling and hydrocarbon production from subterranean formations, in particular, to bottom hole assemblies and methods for drilling ahead through lost circulation zones.

Technical Background

Extracting hydrocarbons from subterranean sources may require drilling a wellbore from the surface to the subterranean geological formation containing the hydrocarbons. The wellbore forms a pathway capable of permitting both fluids and apparatus to traverse between the surface and the subterranean geologic formations. Besides defining the void volume of the wellbore, the wellbore wall also acts as the interface through which fluid can flow from the subterranean formations through which the wellbore traverses to the interior of the wellbore. Hydrocarbon producing wellbores extend subsurface and intersect various subterranean formations where hydrocarbons are trapped.

Specialized drilling techniques and materials are utilized to form the wellbore hole and extract the hydrocarbons. Specialized materials utilized in drilling operations include drilling fluids and materials for sealing the casing-casing annulus of the wellbore, which may be formulated for specific downhole conditions. The wellbore can contain at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore. The fluid conduit may be defined by one or more tubular strings, such as casings, inserted into the wellbore and secured in the wellbore.

During drilling of a wellbore, cementing the wellbore, or both, lost circulation zones may be encountered which result in loss of drilling fluids, cementing compositions, or other fluids. In a lost circulation zone, the drilling fluids, cement compositions, or other fluids flow out of the wellbore and into the surrounding formation. Lost circulation zones may increase the cost of the well through increased material costs to replace lost fluids and downtime to remediate the lost circulation zone.

SUMMARY

Lost circulation zones encountered during wellbore drilling may be remediated by introducing a lost circulation material (LCM), such as bridging materials, fibrous material, flaky material, or other particulates, into the formation in the lost circulation zone to block the pores or fractures in the formation and seal the lost circulation zone from the wellbore. In some instances a cement or curable polymer plug may be set in the wellbore to seal off the lost circulation zone. However, many potential obstacles hinder these conventional lost circulation zone treatments from being fully effective. Lost circulation zones are often encountered at depths requiring a significant time passage before the material can be pumped to the affected lost circulation zone, and the large amounts of drilling fluids in the wellbore can dilute the LCM before it gets to the lost circulation zone. Also the large static pressures downhole further can destabilize the lost circulation zone, causing further fracture and exacerbating the lost circulation issues. Additionally, treating lost circulation zones with LCM or cement or polymer plugs requires a temporary halt in drilling operations and often requires removal of the drill string, which can cause significant downtime in the drilling process.

Accordingly, there is an ongoing need for bottom-hole assemblies (BHA) and systems that enable drilling ahead through lost circulation intervals of a wellbore. The present disclosure is directed to bottom hole assemblies comprising an expandable cladding sheath and methods of drilling ahead through lost circulation zones using the bottom hole assemblies comprising the expandable cladding sheath. The expandable cladding sheath comprises a fiber reinforced plastic or polymer that is drillable. The expandable cladding sheath is made up to the drill string using a cladding seat coupled to the drill string positioned uphole from the drill bit. An uphole end of the expandable cladding sheath further includes a release mechanism operable to release the expandable cladding sheath from the drill string during deployment. The bottom hole assemblies include an expander operable to translate through a center cavity of the expandable cladding sheath to deform the expandable cladding sheath radially outward into contact with the wellbore wall.

The bottom hole assemblies of the present disclosure can be used in methods to drill ahead through a lost circulation zone of a wellbore. The bottom hole assembly can be inserted downhole to drill the wellbore. When a lost circulation zone is encountered, the methods include operating the drill bit of the bottom hole assembly to drill through the lost circulation interval of the lost circulation zone to expose a greater portion or all of the lost circulation zone and then deploying the expandable cladding sheath in the lost circulation interval of the wellbore. The expandable cladding sheath may be expanded with the expander to contact the wellbore wall and form a barrier wall that reduces or prevents flow of fluids from the wellbore into the lost circulation zone. After the expandable cladding sheath is installed, the drill bit may be operated to continue drilling ahead through the lost circulation zone without pulling the drill string from the wellbore.

The bottom hole assemblies of the present disclosure may enable remediation of a lost circulation zone of the wellbore without removing the drill string from the wellbore and with substantially less drilling downtime compared to treatment of the lost circulation zone with LCM or cement plugs. The bottom hole assemblies of the present disclosure may further enable drilling ahead through lost circulation zones using a one trip system that can be made up to a normal bottom hole assembly. The expandable cladding sheath is drillable with normal drill bits and further does not introduce toxic materials into the wellbore, among other features.

According to a first aspect of the present disclosure, a bottom hole assembly for drilling through a lost circulation zone of a wellbore may include a drill string, a drill bit coupled to a downhole end of the drill string, a cladding seat coupled to the drill string, an expandable cladding sheath engaged with the cladding seat, a release mechanism coupling an uphole end of the expandable cladding sheath to the drill string, and an expander translatable axially along the drill string. The cladding seat may releasably couple a downhole end of the expandable cladding sheath to the drill string. The expandable cladding sheath may comprise a fiber reinforced polymer. The release mechanism may be operable to release the uphole end of the expandable cladding sheath from the drill string. The expander may be operable to deform the expandable cladding sheath outward into contact with a wall of a wellbore when translated axially through a central cavity of the expandable cladding sheath.

A second aspect of the present disclosure may include the first aspect, where the release mechanism may comprise a release collet and a J-slot.

A third aspect of the present disclosure may include either one of the first or second aspects, where the expander may comprise a traveling jack expander or a cone expander translatable along the drill string.

A fourth aspect of the present disclosure may include any one of the first through third aspects, where the cladding seat may further comprise a wellbore anchor operable to radially expand within the wellbore to engage with the wall of the wellbore to prevent downhole movement of the bottom hole assembly during deployment and expansion of the expandable cladding sheath.

A fifth aspect of the present disclosure may include a method for drilling ahead through a lost circulation zone of a subterranean formation. The method may include inserting a bottom hole assembly into a wellbore extending into the subterranean formation. The bottom hole assembly may comprise a drill string, a drill bit coupled to a downhole end of the drill string, a cladding seat coupled to the drill string, and an expandable cladding sheath releasably coupled to the cladding seat. The expandable cladding sheath comprises a fiber reinforced polymer. The method may further include drilling across a lost circulation interval of the wellbore, where the lost circulation interval may be a section of the wellbore in fluid communication with the lost circulation zone. The method may further include deploying the expandable cladding sheath in the lost circulation interval of the wellbore and expanding the expandable cladding sheath radially outward into contact with a wall of the wellbore. The expandable cladding sheath may provide a barrier to fluid communication between the wellbore and the lost circulation zone. The method may further include drilling ahead through the subterranean formation after deploying and expanding the expandable cladding sheath.

A sixth aspect of the present disclosure may include the fifth aspect, where drilling ahead after installing the expandable cladding sheath does not require removing the bottom hole assembly or drill string from the wellbore.

A seventh aspect of the present disclosure may include either one of the fifth or sixth aspects, comprising drilling through the lost circulation zone to expose the entire lost circulation interval before deploying the expandable cladding sheath in the lost circulation interval.

An eighth aspect of the present disclosure may include any one of the fifth through seventh aspects, further comprising detecting the lost circulation zone in the wellbore.

A ninth aspect of the present disclosure may include any one of the fifth through eighth aspects, where the bottom hole assembly may further comprise a wellbore anchor coupled to the cladding seat and deploying the expandable cladding sheath in the lost circulation interval may further comprise deploying the wellbore anchor that prevents downhole movement of the bottom hole assembly during deployment of the expandable cladding sheath and activating a release mechanism that releases the expandable cladding sheath from the drill string.

A tenth aspect of the present disclosure may include the ninth aspect, where drilling ahead through the subterranean formation may comprise releasing the wellbore anchor.

An eleventh aspect of the present disclosure may include any one of the fifth through tenth aspects, where expanding the expandable cladding sheath may comprise translating an expander axially through a center cavity of the expandable cladding sheath, where the expander may deform the expandable cladding sheath radially outward towards the wall of the wellbore.

A twelfth aspect of the present disclosure may include the eleventh aspect, where translating the expander axially through a center cavity of the expandable cladding sheath may comprise applying a downward force to the expander.

A thirteenth aspect of the present disclosure may include either one of the eleventh or twelfth aspects, where the expander may be a cone expander or a traveling jack expander.

A fourteenth aspect of the present disclosure may include any one of the first through thirteenth aspects, where the expandable cladding sheath may be impregnated or coated with one or more abrasion resistant materials.

A fifteenth aspect of the present disclosure may include the fourteenth aspect, where the one or more abrasion resistant materials may comprise one or more elastomers.

A sixteenth aspect of the present disclosure may include the fifteenth aspect, where the one or more elastomers may be selected from the group consisting of epoxies, fluoropolymers, urethanes, synthetic rubbers, natural rubbers, phenolic polymers, and combinations of these.

A seventeenth aspect of the present disclosure may include the fifteenth aspect, where the one or more elastomers may comprise natural rubber.

An eighteenth aspect of the present disclosure may include any one of the first through seventeenth aspects, where a polymer of the fiber reinforced polymer may comprise a polymer resin selected from the group consisting of polyester resins, epoxy resins, polyamides, polycarbonates, polyformaldehyde resins, polypropylene, polybutylene terephthalate, vinyl ester resins, and combinations of these.

A nineteenth aspect of the present disclosure may include any one of the first through seventeenth aspects, where a polymer resin of the fiber reinforced polymer may be selected from the group consisting of polyester resins, epoxy resins, polyamides, polycarbonates, polyformaldehyde resins, polypropylene, polybutylene terephthalate, vinyl ester resins, and combinations of these.

A twentieth aspect of the present disclosure may include any one of the first through nineteenth aspects, where the fibers of the fiber reinforced fibers may comprise glass fibers, carbon fibers, aramid fibers, wood fibers, composite material fibers, or combinations of these.

A twenty-first aspect of the present disclosure may include any one of the first through nineteenth aspects, where the fibers of the fiber reinforced polymer may be selected from the group consisting of glass fibers, carbon fibers, aramid fibers, wood fibers, composite material fibers, and combinations of these.

A twenty-second aspect of the present disclosure may include any one of the first through twenty-first aspects, where the expandable cladding sheath may be drillable.

A twenty-third aspect of the present disclosure may include any one of the first through twenty-second aspects, where the expandable cladding sheath does not include metal.

A twenty-fourth aspect of the present disclosure may include any one of the first through twenty-third aspects, where the expandable cladding sheath may comprise a solid wall that does not have perforations or openings extending radially through the solid wall from an inner surface to an outer surface of the expandable cladding sheath.

A twenty-fifth aspect of the present disclosure may include any one of the first through twenty-fourth aspects, where the cladding seat may comprise a threaded coupling engageable with a downhole end of the expandable cladding sheath, the threaded coupling operable to secure the downhole end of the expandable cladding sheath to the drill string during drilling, where rotating the expandable cladding sheath relative to the cladding seat may unscrew and release the downhole end of the expandable cladding sheath from the threaded coupling.

Additional features and advantages of the technology described in this disclosure will be set forth in the detailed description that follows, and in part will be readily apparent to those skilled in the art from the description or recognized by practicing the technology as described in this disclosure, including the detailed description that follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 1:
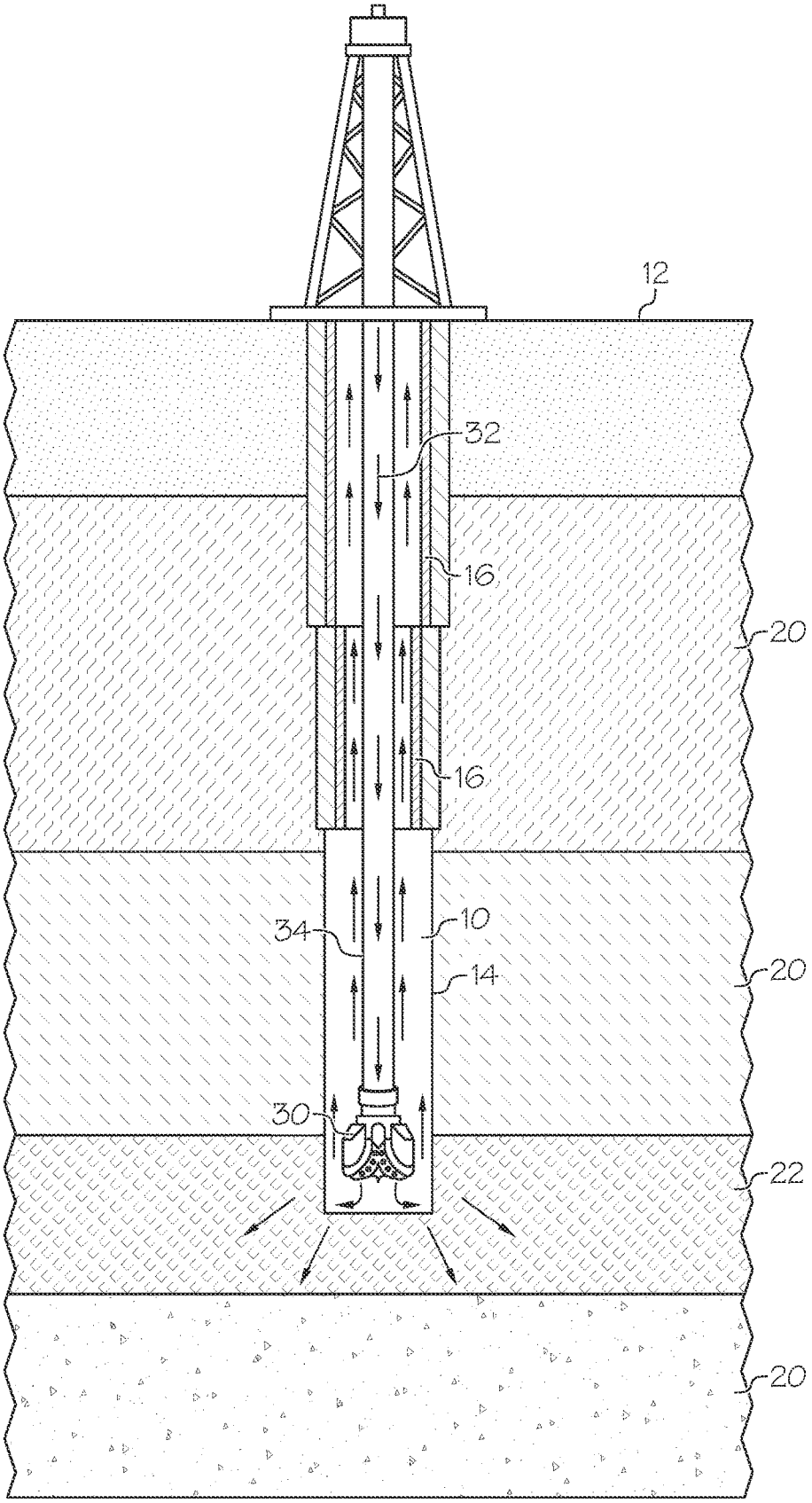
FIG. 1 schematically depicts a wellbore comprising a drill string and drill bit extending into a lost circulation zone of a subterranean formation, according to one or more embodiments shown and described in this disclosure.

The present disclosure is directed to bottom-hole assemblies having expandable cladding sheaths that enable drilling ahead through lost circulation intervals in a wellbore for accessing hydrocarbons from a hydrocarbon bearing subterranean formation. The present disclosure is also directed to methods of drilling ahead through lost circulation intervals using the bottom-hole assemblies of the present disclosure. Referring now to FIG. 1, one embodiment of a bottom-hole assembly 100 that includes an expandable cladding sheath 130 is schematically depicted. The bottom hole assembly 100 includes a drill bit 30 and a drill string 34, where the drill bit 30 is coupled to a downhole end 36 of the drill string 34. The bottom hole assembly 100 further includes a cladding seat 110 rigidly coupled to the drill string 34, the expandable cladding sheath 130 engaged with the cladding seat 110, a release mechanism 140 coupling an uphole end 131 of the expandable cladding sheath 130 to the drill string 34, and an expander 150. The cladding seat 110 may releasably couple a downhole end 132 of the expandable cladding sheath 130 to the drill string 34. The expandable cladding sheath 130 comprises a fiber reinforced polymer. The release mechanism 140 may be operable to release the uphole end 131 of the expandable cladding sheath 130 from the drill string 34. The expander 150 may be operable to deform the expandable cladding sheath 130 outward into contact with a wellbore wall 14 of a wellbore 10 when translated axially through a central cavity 135 of the expandable cladding sheath 130. Methods of remediating lost circulation zones and drilling ahead through a lost circulation zone using the bottom hole assembly 100 of the present disclosure are also disclosed.

The bottom hole assemblies 100 of the present disclosure provides a one trip system for remediating a lost circulation zone and can be made up to a drill string prior to commencing drilling operations. The bottom hole assemblies 100 of the present disclosure may enable remediation of a lost circulation zone of the wellbore without removing the drill string from the wellbore and with substantially less drilling downtime compared to treatment of the lost circulation zone with LCM or cement plugs. The bottom hole assemblies of the present disclosure may further enable drilling ahead through lost circulation zones. The expandable cladding sheath is drillable with normal drill bits and further does not introduce toxic materials into the wellbore. Other features and benefits of the present disclosure may become apparent to persons of ordinary skill of the art from practicing the subject matter of the present disclosure.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean formation" or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production or a subterranean geologic region that must be drilled through to get to the hydrocarbon-bearing formation.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component. The terms "uphole" and "downhole" are not intended to imply a vertical arrangement but rather are directions along a center axis of the drill string relative to the surface.

As used in the present disclosure, the terms "upstream" and "downstream" may refer to the relative positioning of features of the bottom hole assembly with respect to the direction of flow of the wellbore fluids. A first feature of the downhole flow control valve may be considered "upstream" of a second feature if the wellbore fluid flow encounters the first feature before encountering the second feature. Likewise, the second feature may be considered "downstream" of the first feature if the wellbore fluid flow encounters the first feature before encountering the second feature.

As used throughout the present disclosure, the term "fluid" can include liquids, gases, or both and may include solids in combination with the liquids, gases, or both, such as but not limited to suspended solids in the wellbore fluids, entrained particles in gas produced from the wellbore, drilling fluids comprising weighting agents, or other mixed phase suspensions, slurries and other fluids.

As used in the present disclosure, a fluid passing from a first feature "directly" to a second feature may refer to the fluid passing from the first feature to the second feature without passing or contacting a third feature intervening between the first and second feature.

Referring to FIG. 1, a wellbore 10 extending from the surface 12 into a subterranean formation 20 is schematically depicted. The wellbore 10 forms a pathway capable of permitting both fluids and apparatus to traverse between the surface 12 and a hydrocarbon-bearing subterranean formation. Besides defining the void volume of the wellbore 10, the wellbore wall 14 also acts as the interface through which fluid can transition between the subterranean formation 20 and the interior of the wellbore 10. The wellbore wall 14 can be unlined (that is, bare rock or formation) to permit such interaction with the formation or lined, such as by a tubular string 16, so as to prevent such interactions. During drilling of the wellbore 10, the portion of the wellbore 10 being drilled is generally unlined until the drill string can be pulled and the tubular strings 16 can be positioned and cemented in place.

The wellbore 10 may include at least a portion of a fluid conduit that links the interior of the wellbore 10 to the surface 12. The fluid conduit connecting the interior of the wellbore 10 to the surface 12 may be capable of permitting regulated fluid flow from the interior of the wellbore 10 to the surface 12 and may permit access between equipment on the surface 12 and the interior of the wellbore 10. Example equipment connected at the surface 12 to the fluid conduit may include but is not limited to pipelines, tanks, pumps, compressors, and flares. The fluid conduit may be large enough to permit introduction and removal of mechanical devices, including but not limited to tools, drill strings, sensors, instruments, or combinations of these into and out of the interior of the wellbore 10.

The wellbore 10 may be drilled using a drill bit 30 in the presence of a drilling fluid 32. The drill bit 30 may be coupled to a downhole end of a drill string 34, which comprises a length of interconnected piping. During operation of the drill bit 30, the drilling fluid 32 is typically pumped through the interconnected pipe of the drill string 34 to the drill bit 30. The drilling fluids 32 enter the wellbore 10 through the drill bit 32 and flow back through the wellbore 10 to the surface 12, in particular through the annular space between the wellbore 10 and the drill string 34 in a direction from the drill bit 30 towards the surface 12. Drilling fluids 32 are formulated to have rheological properties that enable the drilling fluid to convey cuttings from the drill bit 30 back to the surface 12 of the wellbore 10. The drilling fluid 32 and cuttings may also form a mudcake on the wellbore walls 14 that reduces the permeability of the wellbore walls 14 to reduce fluid communication between the wellbore 10 and the subterranean formation 20.

Referring again to FIG. 1, while drilling the wellbore 10, the drilling operation may encounter a lost circulation zone 22. When a lost circulation zone 22 is encountered during drilling, fluids in the wellbore 10 may flow from the wellbore 10 into the lost circulation zone 22 of the subterranean formation 20, resulting in loss of these fluids to the formation. While some seepage of fluids from the wellbore 10 through the mudcake and into the subterranean formation 20 can be tolerated, excessive fluid loss can greatly increase the costs of drilling the wellbore 10 by increasing material costs to replace lost fluids and downtime to remediate the lost circulation zone 22. Fluids lost to the lost circulation zone 22 can include but are not limited to drilling fluids 32, sealing compositions, spacer fluids, wash fluids, pre-flush fluids, displacement fluids, or combinations of these. In some instances, lost circulation may be caused by the natural state of the subterranean formation 20 through which the wellbore 10 passes. For example, the subterranean formation 20 may be naturally fractured or may be an unconsolidated formation, such as but not limited to gravel, sand, pea, or combinations of these. The subterranean formation 20 may also include caves, caverns, tunnels, or other voids in the formation capable of receiving fluids from the wellbore 10. Alternatively, in other circumstances, the hydrostatic pressure of the fluids in the wellbore 10 may be greater than the fracture gradient of the subterranean formation 20, which may cause at least some breakdown of the pores in the subterranean formation 20. If the pores in the subterranean formation 20 break down, then the pores may become large enough to reduce the resistance to flow of fluids into and through the pores, resulting in the subterranean formation 20 receiving fluids from the wellbore 10 instead of resisting the flow of these fluids into the formation.

Lost circulation zones 22 may be remediated by introducing a lost circulation material (LCM) into the formation in the lost circulation zone 22 to seal the lost circulation zone 22 from the wellbore. The material may be injected or squeezed into the subterranean formation. Conventional lost circulation materials (LCM) can include bridging material, fibrous material, flaky material, cement such as low-cure-time cement, and other materials having different particle sizes. These materials may be effective at mediating many lost circulation zones 22 by blocking pores in the formation and/or forming a layer of solids over the formation at the lost circulation zone 20. To avoid plugging the drill string, in particular, downhole measurement while drilling (MWD), logging while drilling (LWD) tool, and even drill bit nozzles, a circulating tool, sometimes referred to as a "PBL sub" can be activated to divert the LCM fluids into the lost circulation zone 22. If the lost circulation problem is significant, a plug of cement slurry, polymer, or other material may be set in the wellbore 10 adjacent the lost circulation zone 22. The plug can then later be drilled out to resume drilling of the wellbore 10. In some instances, the subterranean formation 20 surrounding the wellbore 10 may contain natural fractures having such a significant volume that the LCM fluids pumped downhole migrate into the lost circulation zone 22 before being set. While LCM, or bridging material, is available that solidifies at certain downhole temperatures or pressures, many potential obstacles hinder these materials from being fully effective. For example, the circulation zones are often at depths requiring a significant time passage before the material can be pumped to the affected lost circulation zone. Further, a large amount of mud in the wellbore between surface and the depth of the lost circulation zone can dilute the LCM or bridging material. Also the large static head existing downhole further can destabilize the lost circulation zone, causing further fracture and exacerbating the lost circulation issues.

While these LCMs may be effective at mediating many lost circulation zones 22, treatment of lost circulation zones 22 with LCM or plugs temporarily halts drilling and prevents drill ahead through the lost circulation zone 22. Ceasing drilling operations to treat the lost circulation zone 22 with LCM or a plug, such as a cement or polymer plug, can introduce significant downtime in the drilling process. Further, treating the lost circulation zone 22 with LCM or a plug requires removing the drill string and halting drilling for an extended period of time during treatment of the lost circulation zone 22.

The present disclosure is directed to bottom hole assemblies comprising an expandable cladding sheath and methods of drilling ahead through lost circulation zones using the bottom hole assemblies comprising the expandable cladding sheath. The bottom hole assemblies of the present disclosure may enable remediation of a lost circulation zone of the wellbore without removing the drill string from the wellbore and with substantially less drilling downtime compared to treatment of the lost circulation zone with LCM or cement plugs. The bottom hole assemblies of the present disclosure may further enable drilling ahead through lost circulation zones.

Figure 2:
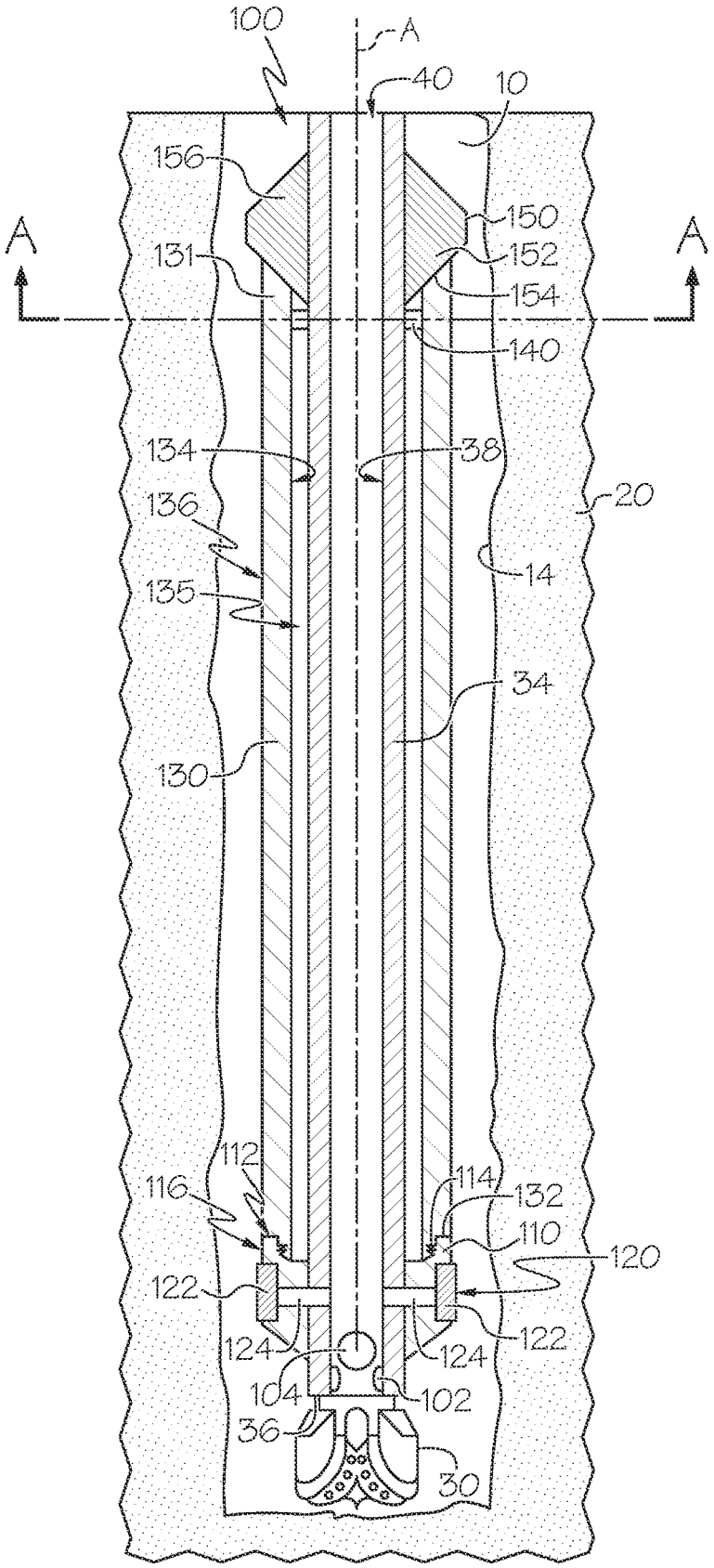
FIG. 2 schematically depicts a side cross-sectional view of a bottom hole assembly for drilling through the lost circulation zone of FIG. 1, according to one or more embodiments shown and described in this disclosure.

Referring again to FIG. 2, the bottom hole assemblies 100 of the present disclosure may include the drill bit 30 coupled to a downhole end 36 of a drill string 34, a cladding seat 110 coupled to the drill string 34 uphole from the drill bit 30, an expandable cladding sheath 130 engaged with the cladding seat 110, a release mechanism 140 coupled to the expandable cladding sheath 130, and an expander 150 coupled to the drill string 34. The expandable cladding sheath 130 may be constructed of a fiber reinforced polymer.

The drill string 34 may comprise a plurality of interconnected pipes extending from the surface 12 down into the wellbore 10. The drill string 34 may have a center axis A that may also be the center axis of the bottom hole assembly 100. In the present disclosure, the axial direction may refer to movement of components in an uphole or downhole direction parallel to the center axis A of the drill string 34. Radial may refer to a direction perpendicular to and outward from the center axis A. The downhole end 36 of the drill string 34 may include a setting ball mechanism for activating a wellbore anchor 120 coupled to the cladding seat 110. The setting ball mechanism may include a setting ball seat 102 protruding inward from an inner surface 38 of the drill string 34. The setting ball seat 102 may be disposed downhole from the cladding seat 110. The setting ball seat 102 may be uphole relative to the drill bit 30. The setting ball seat 102 may be shaped to receive a setting ball 104 and create a fluid tight seal between a fluid passage 40 of the drill string 34 and the wellbore 10 when the setting ball 104 is received in the setting ball seat 102.

The setting ball seat 102 may be shearable, meaning that at least a portion of the setting ball seat 102 may be retractable radially outward towards or into the drill string 34 upon application of a shearing fluid pressure on the setting ball 104 received in the setting ball seat 102. The setting ball seat 102 may be normally biased inward so that the setting ball seat 102 protrudes radially inward into the fluid passage 40 defined by the drill string 34. The shearing fluid pressure is a fluid pressure in the drill string 34 that is sufficient to overcome the inward bias of the setting ball seat 102 and to cause the setting ball seat 102 to shear and retract back into the drill string 34. Shearing of the setting ball seat 102 may allow the setting ball 104 to pass through the setting ball seat 102 and the downhole end 36 of the drill string 34 to remove fluid isolation between the drill string 34 and the wellbore 10.

The drill bit 30 may be coupled to the downhole end 36 of the drill string 30 and positioned downhole relative to the setting ball seat 102. The drill bit 30 may be any device capable of pulverizing rock in the subterranean formation 20 into small pieces called cuttings to create the wellbore 10. The drill bit 30 can be a tri-cone bit, a polycrystalline diamond compact (PDC) bit, or any other type of drill bit 30 capable of drilling a wellbore 10.

Referring again to FIG. 2, the bottom hole assembly 100 further includes a cladding seat 110 coupled to the drill string 34. In embodiments, the cladding seat 110 may be rigidly coupled to the drill string 34. The cladding seat 110 may be disposed uphole from the drill bit 30. The cladding seat 110 may be positioned proximate the drill bit 30 and uphole from the setting ball seat 102. An uphole end 112 of the cladding seat 110 may have a coupling 114 operable to receive a downhole end 132 of the expandable cladding sheath 130. The coupling 114 of the cladding seat 110 may be a threaded coupling such that the expandable cladding sheath 130 can be released from the cladding seat 110 by rotating the expandable cladding sheath 130 in a direction that unscrews the expandable cladding sheath 130 from the coupling 114 of the expandable cladding sheath 130. The cladding seat 110 may be operable to releasably couple the downhole end 132 of the expandable cladding sheath 130 to the drill string 34.

The cladding seat 110 may further include a wellbore anchor 120 that may be operable to expand and engage with the wellbore walls 14 of the wellbore 10 to prevent at least downhole movement of the bottom hole assembly 100 during deployment and expansion of the expandable cladding sheath 130. The wellbore anchor 120 may be integrated with the cladding seat 110 and may include one or a plurality of anchors 122 coupled to a radial outer surface 116 of the cladding seat 110. The anchors 122 may be disposed in or on the radial outer surface 116 of the cladding seat 110. Axially, the anchors 122 may be positioned uphole relative to the setting ball seat 102. The anchors 122 may be expandable or translatable radially outward from the cladding seat 110 to engage with the wellbore wall 14 of the wellbore 10. In embodiments, the anchors 122 may pivot outward when activated. The anchors 122 of the wellbore anchor 120 may by hydraulically activated. When engaged, the anchors 122 may prevent downhole movement of the bottom hole assembly 100 during deployment of the extendable cladding sheath 130. In embodiments, the anchors 122 may reduce or prevent uphole an downhole movement of the bottom hole assembly 100. In embodiments, the wellbore anchor 120 may be separate from the cladding seat 110 and may have a housing independently coupled to the drill string 34 downhole from the cladding seat 110.

The wellbore anchor 120 may further include one or a plurality of hydraulic ports 124 disposed uphole of the setting ball seat 102. Each of the hydraulic ports 124 may extend radially from the inner surface 38 of the drill string 34, through the drill string 34 and cladding seat 110, and to one of the plurality of anchors 122. Each of the hydraulic ports 124 may fluidly couple one of the plurality of anchors 122 to the fluid passage 40 of the drill string 34 to facilitate fluid communication between the fluid passage 40 of the drill string 34 and each of the plurality of anchors 122. Changes in fluid pressure within the fluid passage 40 of the drill string 34 may be transmitted through each of the hydraulic ports 124 to each of the anchors 122. These changes in fluid pressure in the fluid passage 40 may be utilized to deploy the anchors 122.

The wellbore anchor 120 may be deployed by dropping a setting ball 104 down through the fluid passage 40 of the drill string 34. The setting ball 104 engages with the setting ball seat 102 at the downhole end 36 of the drill string 34 to create a seal between the fluid passage 40 of the drill string 34 and the wellbore 10 at the downhole end 36 of the drill string 34. Additional fluids, such as drilling fluid, may then be pumped into the drill string 34 to increase the fluid pressure within the fluid passage 40 of the drill string 34. The increased fluid pressure in the fluid passage 40 may be transmitted to each of the anchors 122 of the wellbore anchor 120 through each of the plurality of hydraulic ports 124. The increased fluid pressure may cause each of the anchors 122 to translate radially outward into engagement with the wellbore wall 14. The wellbore anchor 120, once deployed, may prevent downhole movement of the bottom hole assembly 100 during deployment of the expandable cladding sheath 130.

Referring again to FIG. 2, the expandable cladding sheath 130 may be a hollow cylindrical sheath coupled to the drill string 34. The expandable cladding sheath 130 may have an uphole end 131 and a downhole end 132. The downhole end 132 may be releasably coupled to the cladding seat 110. In embodiments, the downhole end 132 of the expandable cladding sheath 130 may be threaded so that the downhole end 132 can be engaged with the threaded coupling 114 on the cladding seat 110, such as by screwing the expandable cladding sheath 130 into the cladding seat 110. The expandable cladding sheath 130 has an inner surface 134 that defines a cavity 135 through which the drill string 34 passes. The expandable cladding sheath 130 has an outer surface 136 that may engage with the wellbore wall 14 when the expandable cladding sheath 130 is deployed and expanded in the lost circulation interval of the wellbore 10. The expandable cladding sheath 130 may be a solid sheath that does not have any perforations extending radially through the wall from the inner surface 134 to the outer surface 136. The expandable cladding sheath 130 may be expandable in the radially outward direction, such as through deforming the expandable cladding sheath 130 radially outward with the expander 150.

The expandable cladding sheath 130 comprises a fiber reinforced polymer, which may comprise fibers distributed throughout a polymer matrix. The polymer matrix may include a polymer resin that is expandable and is suitable for downhole conditions, such as temperatures from 100° C. to 200° C. and downhole pressures. The polymer may be stable at downhole conditions, meaning that the polymer matrix does not breakdown chemically or physically when exposed to downhole conditions, such as downhole temperatures, downhole pressures, and downhole chemical environment. Polymer resins suitable for the polymer matrix of the expandable cladding sheath 130 may include, but are not limited to polyester resins, epoxy resins, polyamides, polycarbonates, polyformaldehyde resins, polypropylene, polybutylene terephthalate, vinyl ester resins, or combinations of these. These polymer resins useful for the polymer matrix of the expandable cladding sheath 130 may provide wear resistance properties to the expandable cladding sheath 130. In embodiments, the polymer matrix of the of the expandable cladding sheath 130 may include one or a plurality of polymer resins selected from the group consisting of polyester resins, epoxy resins, polyamides, polycarbonates, polyformaldehyde resins, polypropylene, polybutylene terephthalate, vinyl ester resins, and combinations of these.

In embodiments, the expandable cladding sheath 130 may include a first polymer resin and a second polymer resin coated onto or impregnated into the first polymer resin as a protective wear resistant coating. The first polymer resin may be selected from the group consisting of polyester resins, epoxy resins, polyamides, polycarbonates, polyformaldehyde resins, polypropylene, polybutylene terephthalate, vinyl ester resins, and combinations of these. The first polymer resin may be the primary polymer resin forming the expandable cladding sheath 130. The second polymer resin may be different from the first polymer resin and may also be selected from the group consisting of polyester resins, epoxy resins, polyamides, polycarbonates, polyformaldehyde resins, polypropylene, polybutylene terephthalate, vinyl ester resins, and combinations of these. The second polymer resin of the expandable cladding sheath 130 may be coated onto or impregnated into the first polymer resin using conventional coating or impregnation techniques.

The fibers of the fiber reinforced polymer may include any fibers stable at downhole conditions and capable of imparting improved strength to the polymer resin. The term "stable" may refer to the fibers or polymer resins not breaking down chemically or physically when exposed to the downhole conditions such as elevated temperature and pressure and chemical environment, such as but not limited to high salinity. Fibers suitable for the fiber reinforced polymer of the expandable cladding sheath may include but are not limited to glass fibers, carbon fibers, aramid fibers, wood fibers, composite fibers, or combinations of these. In embodiments, the fiber reinforced polymer comprises glass fibers or carbon fibers. In embodiments, the expandable cladding sheath 130 does not include a metal. The expandable cladding sheath 130 may be drillable to allow portions of the expandable cladding sheath 130 to be drilled through if needed.

The expandable cladding sheath 130 may be impregnated or coated with one or more abrasion resistant materials. The abrasion resistant materials may reduce or prevent wear of the expandable cladding sheath 130 deployed in the wellbore 10 caused by flow of drilling fluids and rock cuttings through the wellbore and movement of the drill string, completion tools, or other equipment through the wellbore 10. The abrasion resistant materials may include one or more elastomers. The elastomers may be stable at downhole conditions, such as downhole temperatures, downhole pressures, or downhole chemical environment. The one or more elastomers may include but are not limited to elastomers selected from the group consisting of epoxies, fluoropolymers, urethanes, synthetic rubbers, natural rubbers, phenolic polymers, and combinations of these. In embodiments, the elastomer is natural rubber. In embodiments, the expandable cladding sheath 130 may comprise natural rubber coated onto or impregnated into the fiber reinforced polymer.

Figure 3:
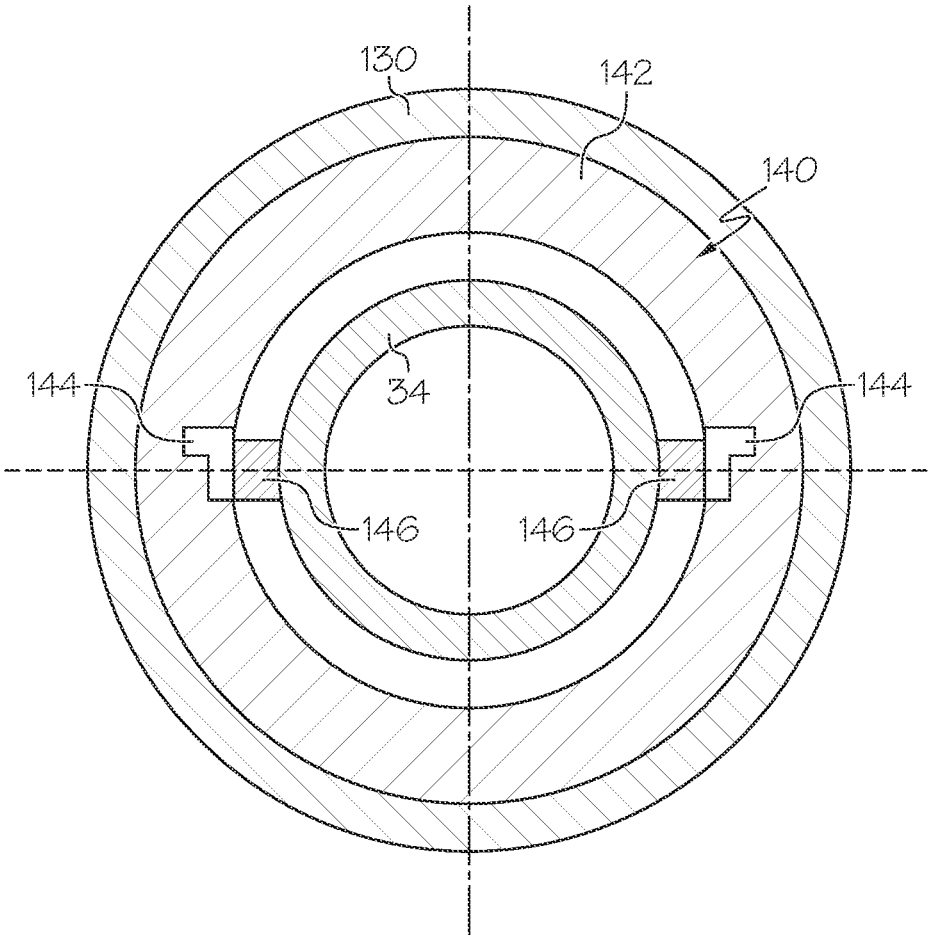
FIG. 3 schematically depicts a top view of a release mechanism of the bottom hole assembly of FIG. 2, according to one or more embodiments shown and described in this disclosure.

Referring again to FIG. 2, the bottom hole assembly 100 may include the release mechanism 140 that releasably couples the uphole end 131 of the expandable cladding sheath 130 to the drill string 34. Referring now to FIG. 3, the release mechanism 140 may comprise a release collet 142 coupled to the uphole end 131 of the expandable cladding sheath 130. The release collet 142 may include a J-slot 144. The drill string 34 may include a key 146 engageable with the J-slot 144 of the release collet 142. The release collet 142 may be unlocked by raising the drill string 34 to engage the key 146 with the J-slot 144 and turning the drill string 34, which moves the key 146 within the J-slot 144 to unlock the release collet 142 and release the uphole end 131 of the expandable cladding sheath 130 from the drill string 34. The release mechanism 140 may include any other type of mechanism for releasably coupling the uphole end 131 of the expandable cladding sheath 130 to the drill string 34.

Referring again to FIG. 2, the bottom hole assembly 100 includes the expander 150, which may be initially positioned on the drill string 34 at or uphole from the uphole end 132 of the expandable cladding sheath 130. The expander 150 may be translatable along the drill string 34 in at least a downhole direction relative to the expandable cladding sheath 130. In embodiments, the expander 150 may be slidable along the radial outer surface of the drill string 34. A portion of the expander 150 may have an outer diameter greater than an inner diameter of the expandable cladding sheath 130. The expander 150 may be operable to deform the expandable cladding sheath 130 radially outward when translated axially through the central cavity 135 of the expandable cladding sheath 130. In embodiments, the expander 150 may be operable to deform the expandable cladding sheath 130 radially outward into contact with the wellbore wall 14 of the wellbore 10 when translated axially through the central cavity 135 of the expandable cladding sheath 130.

The expander 150 may be any device capable of translating axially along the drill string 34 and expanding the expandable cladding sheath 130 outward towards the wellbore wall 14. The expander may be a traveling jack expander or a cone expander. In embodiments, the expander 150 may be a cone expander comprising a frusto-conical expansion cone 152. The frusto-conical expansion cone 152 that may have a tapered section 154 that radially expands from an outside diameter smaller than an inside diameter of the expandable cladding sheath 130 at a lower end, to an outside diameter that is larger than the inside diameter of the expandable cladding sheath 130 at an upper end. The expander 150 has a longitudinal bore that allows passage of the drill string 34 so that the expander 150 surrounds at least a portion of the drill string 34. The outer diameter of the drill string 34 is smaller than an inner diameter of the longitudinal bore of the expander 150, so that the expander 150 can slide axially relative to the drill string 34. In embodiments, the expander may optionally include a top section 156 that tapers radially inward.

The bottom hole assembly 100 may include any other components typically utilized in wellbore drilling. Other components of the bottom hole assembly 100 may include, but are not limited to, an under reamer, a mud pump, sensors such as flow sensors or pressure sensors, or other instruments. Other equipment and components coupled to the drill string 34 are contemplated.

Referring to FIGS. 4-8, operation of the bottom hole assembly 100 for drilling through a lost circulation zone 22 of a wellbore 10 will now be described in further detail. In FIGS. 4-8, operation of the bottom hole assembly 100 in a vertical wellbore 10 is schematically depicted. Although shown and described herein in the context of a vertical wellbore, it is understood that the bottom hole assemblies 100 of the present disclosure may be suitable for drilling through and remediating lost circulation zones in wellbores of any orientation, such as but not limited to horizontal wellbores, angled wellbores, or laterals.

Figure 4:
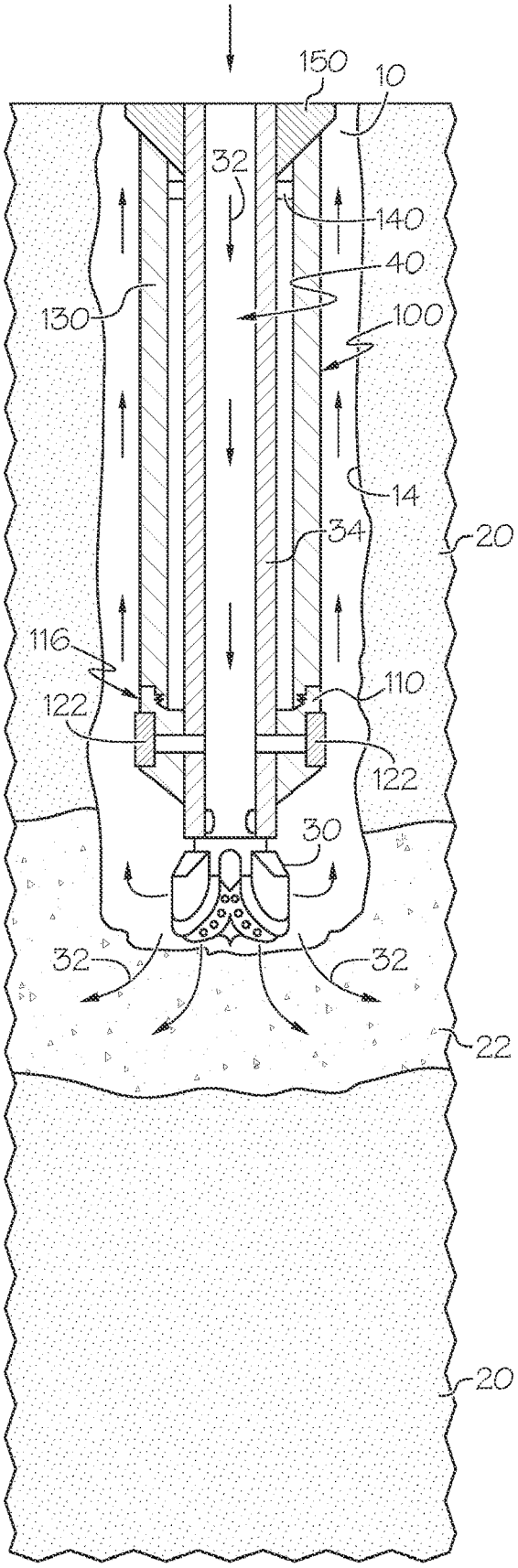
FIG. 4 schematically depicts a side cross-sectional view of the bottom hole assembly of FIG. 2 during drilling a wellbore, where the bottom hole assembly encounters a lost circulation zone, according to one or more embodiments shown and described in this disclosure.

Referring now to FIG. 4, the bottom hole assembly 100 may be made up to the drill string 34 at the surface 12 (FIG. 1) prior to drilling the wellbore 10 such that drilling the wellbore 10 through the subterranean formation 20 is conducted with the bottom hole assembly 100 comprising the expandable cladding sheath 130 coupled to the drill string 34. Referring to FIG. 4, the bottom hole assembly 100 may be inserted into the wellbore 10. Normal drilling operations can be conducted with the drill bit 30 of the bottom hole assembly 100 until the bottom hole assembly 100 encounters a lost circulation zone 22. When the bottom hole assembly 100 encounters a lost circulation zone 22, the drilling fluid 130 (drilling mud) may flow from the wellbore 10 into the lost circulation zone 22 as indicated by the arrows in FIG. 4 that extend from the wellbore 10 into the lost circulation zone 22. The loss of drilling fluid 32 to the lost circulation zone 22 may cause a reduction in pressure, flow rate, or both of the drilling fluid 32 back through the wellbore 10 to the surface. The lost circulation zone 22 may be identified by monitoring one or more wellbore drilling conditions, such as pressure or flow rate of the drilling fluid returned through the wellbore 10 to the surface.

Figure 5:
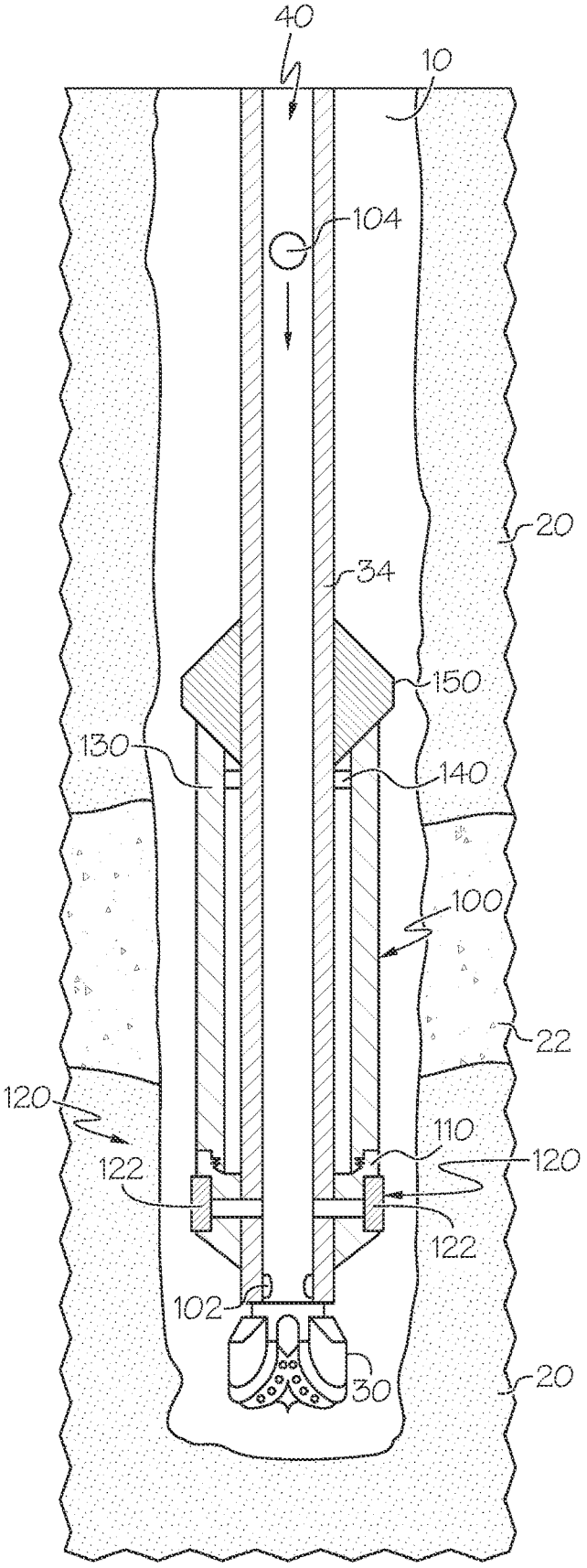
FIG. 5 schematically depicts a side cross-sectional view of the bottom hole assembly of FIG. 4 after drilling through the lost circulation zone, according to one or more embodiments shown and described in this disclosure.

Referring now to FIG. 5, when the lost circulation zone 22 is encountered, the drill bit 30 may be operated to drill through the lost circulation zone 22 to expose the entire lost circulation interval of the wellbore 10. In embodiments, the drill bit 30 may be operated to drill an additional depth equal to or greater than the axial length of the expandable cladding sheath 130. Once the drill bit 30 has drilled through the lost circulation zone 22, the bottom hole assembly 100 may be positioned within the wellbore 10 to align the expandable cladding sheath 130 with the lost circulation zone 22. When the bottom hole assembly 100 is in position, the setting ball 104 may be dropped down into the fluid passage 40 of the drill string 34 to facilitate deployment of the wellbore anchor 120. The setting ball 104 may travel through the fluid passage 40 of the drill string 34 in the downhole direction to engage with the setting ball seat 102 at the downhole end of the drill string 34. The setting ball 104 may travel downhole through gravity or by pushing the setting ball 104 downhole with fluid flow, such as by pumping drilling fluid or other fluid into the drill string 34 after the setting ball 104.

Figure 6:
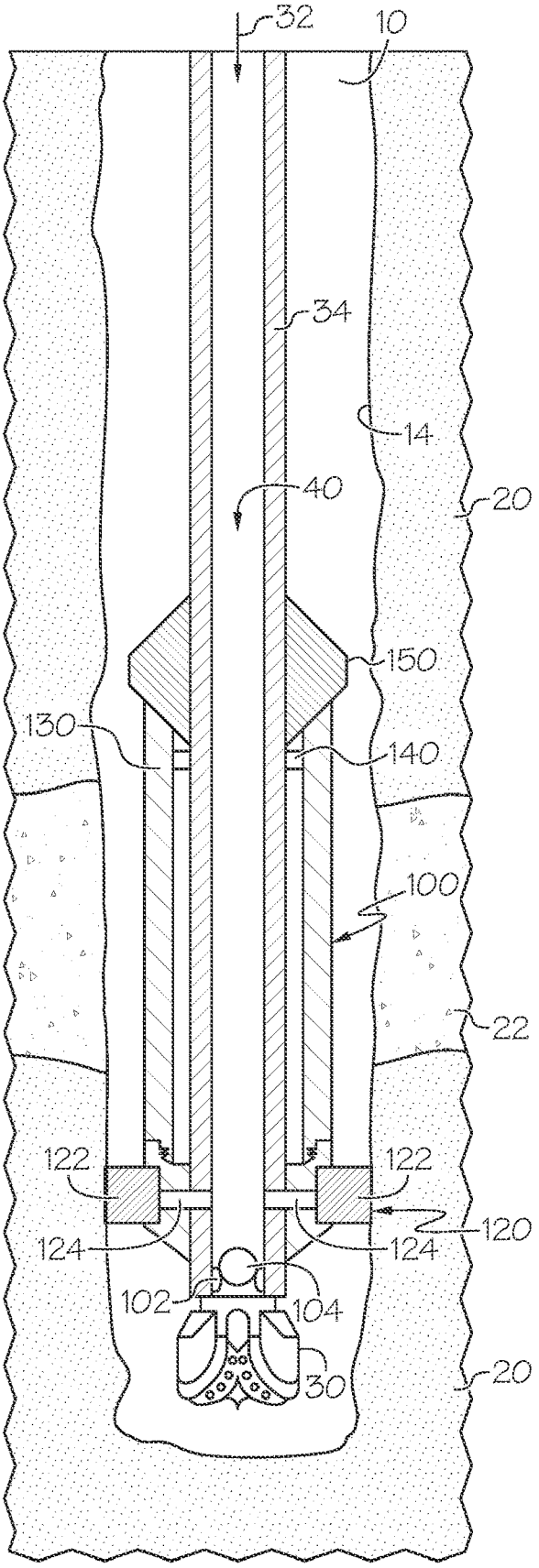
FIG. 6 schematically depicts a side cross-sectional view of the bottom hole assembly of FIG. 5 during deployment of a wellbore anchor of the bottom hole assembly, according to one or more embodiments shown and described in this disclosure.

Referring now to FIG. 6, the setting ball 104 may seat in the setting ball seat 102 to block fluid flow from exiting the downhole end 36 of the drill string 34. Once the setting ball 104 is in position, the wellbore anchor 120 may be deployed to prevent movement of the bottom hole assembly 100 in at least the downhole direction during deployment of the expandable cladding sheath 130. To deploy the wellbore anchor 120, fluids, such as drilling fluid 32, may be pumped into the drill string 34 to increase the fluid pressure within the fluid passage 40 of the drill string 34. The increased fluid pressure may be translated to the plurality of anchors 122 through the hydraulic ports 124, which extend through the drill string 34 and cladding seat 110 to fluidly couple the fluid passage 40 of the drill string 34 with the anchors 122.

Increasing the fluid pressure in the fluid passage 40 of the drill string 34 may cause actuation of the anchors 122. The fluid pressure may cause at least a portion of the anchors 122 to actuate radially outward into engagement with the wellbore wall 14. Engagement of the anchors 122 with the wellbore wall 14 may prevent movement of the bottom hole assembly 100 in at least the downhole direction, and optionally the uphole direction, during deployment of the expandable cladding sheath 130. Additionally, engagement of the anchors 122 with the wellbore wall 14 may provide a counterforce to counter the forces applied to the expander 150 to translate the expander 150 through the central cavity 135 of the expandable cladding sheath 130.

Figure 7:
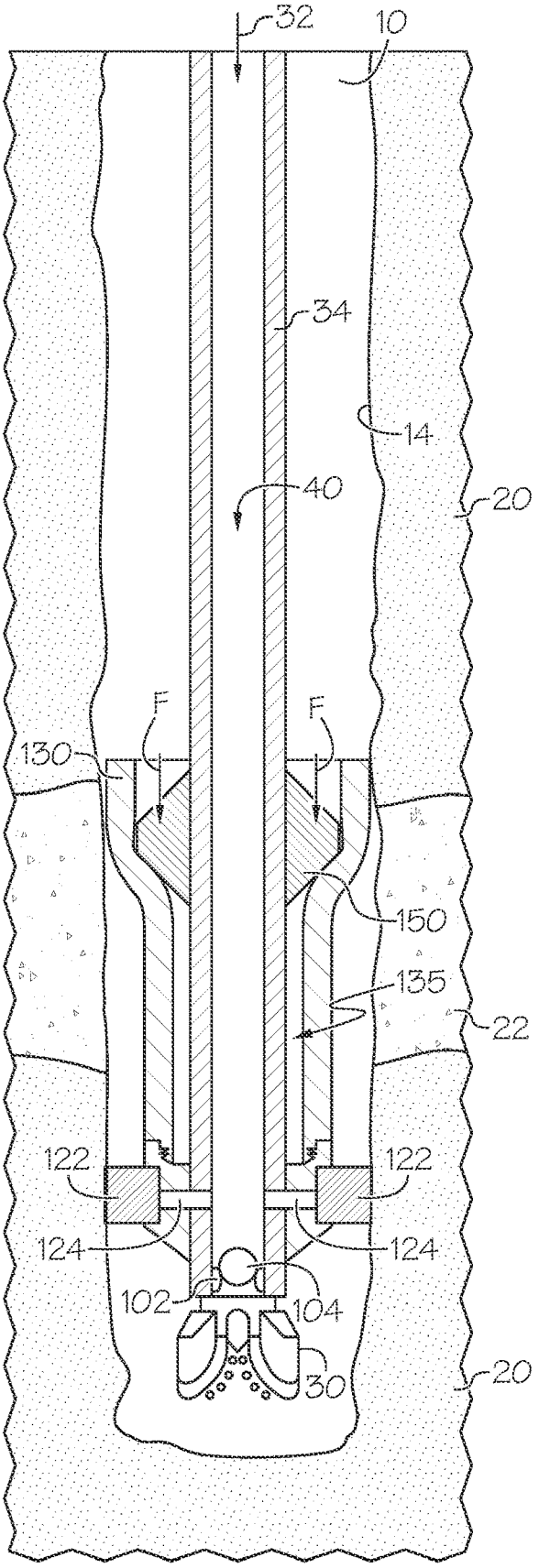
FIG. 7 schematically depicts a side cross-sectional view of the bottom hole assembly of FIG. 6 during deployment of the expandable cladding sheath, according to one or more embodiments shown and described in this disclosure.

Referring now to FIG. 7, once the anchors 122 have been actuated into engagement with the wellbore wall 14, the expandable cladding sheath 130 may be deployed in the wellbore 10. Deployment of the expandable cladding sheath 130 may include operating the release mechanism to release the expandable cladding sheath 130 from the drill string 34 and expanding the expandable cladding sheath 130 with the expander 150. When the release mechanism 140 comprises the release collet 142 having a J-slot, releasing the expandable cladding sheath 130 from the drill string 34 may include engaging the key 146 on the drill string 34 with the J-slot 144 on the release collet 142 (FIG. 3). The drill string 34 may be turned and lowered to unlock the release collet 142, which in turn releases the uphole end 131 of the expandable cladding sheath 130 from the drill string 34.

The key 146 and J-slot 144 of the release collet 142 may also be used to rotate the expandable cladding sheath 130 relative to the cladding seat 110 to unscrew and release the downhole end 132 of the expandable cladding sheath 130 from the cladding seat 110. During drilling mode prior to deployment of the expandable cladding sheath 130, the J-slot 144 of the release mechanism 140 may prevent rotation of the drill string 34 from being transmitted axially to the expandable cladding sheath 130 or cladding seat 110 so that the downhole end 132 of the expandable cladding sheath 130 is not inadvertently released from the cladding seat 110 during drilling. In embodiments, the cladding seat 110 may be left-hand threaded so that clockwise rotation of the expandable cladding sheath 130 relative to the cladding seat 110 may unscrew and release the expandable cladding sheath 130 from the cladding seat 110. Additionally, counterclockwise rotation of the cladding seat 110 relative to the expandable cladding sheath 130 may also unscrew and release the downhole end 132 of the expandable cladding sheath 130 from the cladding seat 110.

Referring again to FIG. 7, once the expandable cladding sheath 130 is released from the drill string 34, the expander 150 may be translated axially through the central cavity 135 of the expandable cladding sheath 130 to expand the expandable cladding sheath 130 radially outward and into contact with the wellbore wall 14. In embodiments, the expander 150 may be a cone expander 152 and may be translated axially through the central cavity 135 of the expandable cladding sheath 130 by applying a force F in the downhole direction to the cone expander 152. The force F may be applied through fluid pressure or mechanically through the use of one or more wellbore tools. The force F may cause the cone expander 152 to translate in the downhole direction through the central cavity 135 of the expandable cladding sheath 130. The frusto-conical portion of the cone expander 152 may engage with the inner surface 134 of the expandable cladding sheath 130 to deform the expandable cladding sheath 130 radially outward towards the wellbore wall 14.

Figure 8:
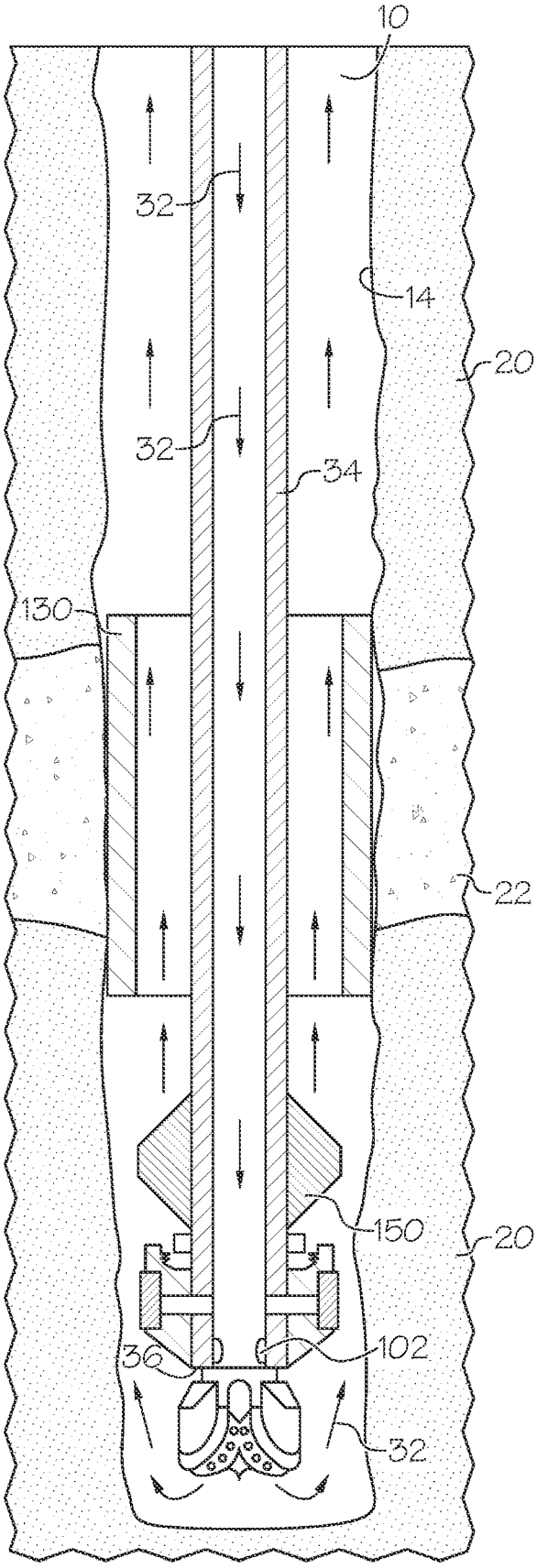
FIG. 8 schematically depicts a side cross-sectional view of the bottom hole assembly of FIG. 6 drilling ahead through the formation after deployment of the expandable cladding sheath, according to one or more embodiments shown and described in this disclosure.

Referring to FIG. 8, expansion of the expandable cladding sheath 130 radially outward into contact with the wellbore wall 14 may create a mechanical barrier that may reduce or prevent fluid flow from the wellbore 10 into the lost circulation zone 22. After deployment of the expandable cladding sheath 130, the pressure in the drill string 34 may be increased to a threshold pressure that is sufficient to cause the setting ball seat 102 to shear and allow the setting ball 104 to pass through the downhole end 36 of the drill string 34. Once the expandable cladding sheath 130 is deployed and the setting ball 104 is removed, the drill bit 30 may resume operation to continue drilling ahead into the subterranean formation 20 without removing the bottom hole assembly 100 from the wellbore 10. Installation of the expandable cladding sheath 130 may enable remediation of the lost circulation zone 22 without requiring removal of the drill string 34 and bottom hole assembly 100 from the wellbore 10. Thus, drilling ahead through the subterranean formation 20 can resume with reduced drilling downtime compared to treating the lost circulation zone with lost circulation materials or plugs.

Referring again to FIG. 2, the bottom hole assemblies 100 of the present disclosure may be used in methods for drilling ahead through a lost circulation zone 22 of a subterranean formation 20. The methods of the present disclosure for drilling ahead through a lost circulation zone 22 of a subterranean formation 20 may include inserting the bottom hole assembly 100 into a wellbore 10 that extend into the subterranean formation 20. The bottom hole assembly 100 may include any of the features previously discussed in the present disclosure for the bottom hole assembly 100 or any of its constituent parts. The bottom hole assembly 100 may comprise the drill string 34, the drill bit 30 coupled to the downhole end 36 of the drill string 34, the cladding seat 110 coupled to the drill string 34, and an expandable cladding sheath 130 releasably coupled to the cladding seat 110. The expandable cladding sheath 130 may comprise a fiber reinforced polymer. The methods of the present disclosure may further include drilling across the lost circulation interval of the wellbore 10, where the lost circulation interval is a section of the wellbore 10 in fluid communication with the lost circulation zone 22. The methods may further include deploying the expandable cladding sheath 130 in the lost circulation interval of the wellbore 10 and expanding the expandable cladding sheath 130 radially outward into contact with the wellbore wall 14 of the wellbore 10. The expandable cladding sheath 130 may provide a barrier to fluid communication between the wellbore 10 and the lost circulation zone 22. The methods may further include drilling ahead through the subterranean formation 20 after deploying and expanding the expandable cladding sheath 130 in the lost circulation interval. In embodiments, drilling ahead through the subterranean formation 20 after installing the expandable cladding sheath 130 does not require removing the bottom hole assembly 100, drill string 34, or both from the wellbore 10. In embodiments, the method may include drilling through the lost circulation zone 22 to expose the entire lost circulation interval before deploying the expandable cladding sheath 130 in the lost circulation interval.

The methods of the present disclosure may include detecting the lost circulation zone 22 in the wellbore 10. Lost circulation zones 22 of the wellbore 10 may be detected by any of the methods known in the art for detecting lost circulation zones 22. Methods for detecting lost circulation zones 22 may include identifying sudden decreases in pressure or flow rate of drilling fluids returned to the surface during drilling, leak-off tests, formation integrity tests, geologic surveys, or other methods or combinations of methods.

As previously discussed, the bottom hole assembly 100 may include the wellbore anchor 120 coupled to the cladding seat 110 or to the drill string 34. The wellbore anchor 120 may have any of the features previously described in the present disclosure for the wellbore anchor 120. Deploying the expandable cladding sheath 130 in the lost circulation interval may include deploying the wellbore anchor 120 that prevents downhole movement of the bottom hole assembly 100 during deployment of the expandable cladding sheath 100. The wellbore anchor 120 may prevent both downhole and uphole movement of the bottom hole assembly 100 during deployment of the expandable cladding sheath 130. The wellbore anchor 120 may be deployed before the expandable cladding sheath 130 is released from the still string 34. The methods may include, after engaging the wellbore anchor 120, activating the release mechanism 140 that releases the expandable cladding sheath 130 from the drill string 34. The release mechanism 140 may have any of the features previously described in the present disclosure. In embodiments, the release mechanism 140 may include a release collet 142 with a J-slot 144 and activating the release mechanism 140 may include engaging a lug on the drill string 34 with the J-slot 144 of the release collet 142 and rotating the drill string 34 to release the release collet 142.

In the methods of the present disclosure, expanding the expandable cladding sheath 130 may include translating the expander 150 axially through the center cavity 135 of the expandable cladding sheath 130, where the expander 150 deforms the expandable cladding sheath 130 radially outward towards the wellbore wall 14 of the wellbore 10. Translating the expander 150 axially through the center cavity 135 of the expandable cladding sheath 130 may include applying a force to the expander 150 in the downhole direction. The expander 150 may be a traveling jack expander or a cone expander. In the methods of the present disclosure, drilling ahead through the subterranean formation 20 may include releasing the wellbore anchor 120 from engagement with the wellbore wall 10. In embodiments of the methods, drilling ahead through the subterranean formation 20 may include raising the bottom hole assembly 100 to a position uphole of the expandable cladding sheath 130 deployed in the wellbore 10 and then drilling through at least a portion of the expandable cladding sheath 130, such as drilling through the innermost portions of the expandable cladding sheath 130 that extend into the path of the drill bit 30.

In the methods of the present disclosure, the expandable cladding sheath 130 may have any of the features or compositions previously described herein for the expandable cladding sheath 130. The polymer of the fiber reinforced polymer of the expandable cladding sheath 130 may be a polymer resin selected from the group consisting of polyester resins, epoxy resins, polyamides, polycarbonates, polyformaldehyde resins, polypropylene, polybutylene terephthalate, vinyl ester resins, and combinations of these. The fibers of the fiber reinforced polymer may be selected from the group consisting of glass fibers, carbon fibers, aramid fibers, wood fibers, composite material fibers, and combinations of these. The expandable cladding sheath 130 further may be further impregnated or coated with one or more abrasion resistant materials. The one or more abrasion resistant materials comprise one or more elastomers. The elastomers may be selected from the group consisting of fluoropolymers, urethanes, synthetic rubbers, natural rubbers, phenolic polymers, and combinations of these. In embodiments, the elastomer may be natural rubber. In embodiments, the expandable cladding sheath 130 may not include metals. In embodiments, the expandable cladding sheath 130 may comprise a solid wall that does not include any perforations or openings extending radially through the wall from the inner surface 134 to the outer surface 136 of the expandable cladding sheath 130.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A bottom hole assembly for drilling through a lost circulation zone of a wellbore, the bottom hole assembly comprising:

a drill string;

a drill bit coupled to a downhole end of the drill string;

a cladding seat rigidly coupled to the drill string and comprising a coupling;

an expandable cladding sheath received in the coupling of the cladding seat;

a release mechanism coupling an uphole end of the expandable cladding sheath to the drill string; and an expander translatable axially along the drill string, where:

the cladding seat releasably couples a downhole end of the expandable cladding sheath to the drill string;

the expandable cladding sheath comprises a fiber reinforced polymer;

the release mechanism is operable to release the uphole end of the expandable cladding sheath from the drill string; and the expander is operable to deform the expandable cladding sheath outward into contact with a wall of a wellbore when translated axially through a central cavity of the expandable cladding sheath.

2. The bottom hole assembly of claim 1, where the expandable cladding sheath is impregnated or coated with one or more abrasion resistant materials, where the one or more abrasion resistant materials comprises one or more elastomers selected from the group consisting of epoxies, fluoropolymers, urethanes, synthetic rubbers, natural rubbers, phenolic polymers, and combinations of these.

3. The bottom hole assembly of claim 2, where the one or more elastomers comprise natural rubber.

4. The bottom hole assembly of claim 1, where a polymer of the fiber reinforced polymer comprises a polymer resin selected from the group consisting of polyester resins, epoxy resins, polyamides, polycarbonates, polyformaldehyde resins, polypropylene, polybutylene terephthalate, vinyl ester resins, and combinations of these.

5. The bottom hole assembly of claim 1, where the expandable cladding sheath is drillable.

6. The bottom hole assembly of claim 1, where the expandable cladding sheath comprises a solid wall that does not have perforations or openings extending radially through the solid wall from an inner surface to an outer surface of the expandable cladding sheath.

7. The bottom hole assembly of claim 1, where the fibers of the fiber reinforced polymer comprise glass fibers, carbon fibers, aramid fibers, wood fibers, composite material fibers, or combinations of these.

8. The bottom hole assembly of claim 1, where the release mechanism comprises a release collet and a J-slot.

9. The bottom hole assembly of claim 1, where the expander comprises a traveling jack expander or a cone expander translatable along the drill string.

10. The bottom hole assembly of claim 1, where the cladding seat further comprises a wellbore anchor operable to radially expand within the wellbore to engage with the wall of the wellbore to prevent downhole movement of the bottom hole assembly during deployment and expansion of the expandable cladding sheath.

11. The bottom hole assembly of claim 1, where:

the coupling of the cladding seat is a threaded coupling;

the downhole end of the expandable cladding sheath is threaded; and the threaded coupling of the cladding seat receives the threaded downhole end of the expandable cladding sheath.

12. A method for drilling ahead through a lost circulation zone of a subterranean formation, the method comprising:

inserting a bottom hole assembly into a wellbore extending into the subterranean formation, the bottom hole assembly comprising:

a drill string;

a drill bit coupled to a downhole end of the drill string;

a cladding seat rigidly coupled to the drill string and comprising a coupling; and an expandable cladding sheath received in the coupling of the cladding seat, where the cladding seat releasably couples a downhole end of the expandable cladding sheath to the drill string and the expandable cladding sheath comprising a fiber reinforced polymer;

drilling across a lost circulation interval of the wellbore, where the lost circulation interval is a section of the wellbore in fluid communication with the lost circulation zone;

deploying the expandable cladding sheath in the lost circulation interval of the wellbore;

expanding the expandable cladding sheath radially outward into contact with a wall of the wellbore, where the expandable cladding sheath provides a barrier to fluid communication between the wellbore and the lost circulation zone; and drilling ahead through the subterranean formation after deploying and expanding the expandable cladding sheath.

13. The method of claim 12, where drilling ahead after installing the expandable cladding sheath does not require removing the bottom hole assembly or drill string from the wellbore.

14. The method of claim 12, comprising drilling through the lost circulation zone to expose the entire lost circulation interval before deploying the expandable cladding sheath in the lost circulation interval.

15. The method of claim 12, further comprising detecting the lost circulation zone in the wellbore.

16. The method of claim 12, where the bottom hole assembly further comprises a wellbore anchor coupled to the cladding seat and deploying the expandable cladding sheath in the lost circulation interval further comprises:

deploying the wellbore anchor that prevents downhole movement of the bottom hole assembly during deployment of the expandable cladding sheath;

activating a release mechanism that releases the expandable cladding sheath from the drill string; and releasing the downhole end of the expandable cladding sheath from the cladding seat.

17. The method of claim 16, where drilling ahead through the subterranean formation comprises releasing the wellbore anchor.

18. The method of claim 16, where:

the release mechanism comprises a release collet comprising a J-slot;

the coupling of the cladding seat comprises a threaded coupling;

releasing the uphole end comprises engaging a key with the J-slot on the release collet and rotating and lowering the key in the J-slot to release the release collet; and releasing the downhole end of the expandable cladding sheath comprises rotating the expandable cladding sheath relative to the cladding seat to unscrew the downhole end of the expandable cladding sheath from the threaded coupling of the cladding seat.

19. The method of claim 12, where expanding the expandable cladding sheath comprises translating an expander axially through a center cavity of the expandable cladding sheath, where the expander deforms the expandable cladding sheath radially outward towards the wall of the wellbore.

20. The method of claim 19, where translating the expander axially through a center cavity of the expandable cladding sheath comprises applying a downward force to the expander, where the expander is a cone expander or a traveling jack expander.

* * * * *